US006214787B1

(12) United States Patent
Yamaguchi et al.

(10) Patent No.: US 6,214,787 B1
(45) Date of Patent: Apr. 10, 2001

(54) GRANULAR DETERGENT COMPOSITION FOR CLOTHING

(75) Inventors: Shu Yamaguchi; Shigeru Tamura; Futoshi Teranishi; Noriaki Ushio; Masaki Tsumadori; Hiroyuki Yamashita, all of Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/142,555

(22) PCT Filed: Mar. 10, 1997

(86) PCT No.: PCT/JP97/00749

§ 371 Date: Sep. 11, 1998

§ 102(e) Date: Sep. 11, 1998

(87) PCT Pub. No.: WO97/33968

PCT Pub. Date: Sep. 18, 1997

(30) Foreign Application Priority Data

Mar. 11, 1996 (JP) ..... 8-083238

(51) Int. Cl.[7] ..... C11D 3/08; C11D 10/02; C11D 17/06

(52) U.S. Cl. ..... 510/511; 510/507; 510/508; 510/349; 510/353; 510/361; 510/446

(58) Field of Search ..... 510/511, 507, 510/508, 349, 353, 361, 446

(56) References Cited

U.S. PATENT DOCUMENTS

| | | | | |
|---|---|---|---|---|
| 4,166,039 | * | 8/1979 | Wise | 252/110 |
| 4,264,464 | * | 4/1981 | Gangwish et al. | 252/91 |
| 4,462,804 | * | 7/1984 | Gangwisch et al. | 8/137 |
| 4,585,642 | * | 4/1986 | Rieck | 423/333 |
| 5,393,455 | * | 2/1995 | Poethkow et al. | 252/174.25 |
| 5,482,642 | * | 1/1996 | Agar et al. | 252/90 |
| 5,538,671 | * | 7/1996 | Morrall | 510/476 |
| 5,540,855 | * | 7/1996 | Baillely et al. | 510/276 |
| 5,705,473 | * | 1/1998 | Kuroda et al. | 510/441 |
| 5,733,862 | * | 3/1998 | Capeci et al. | 510/444 |
| 5,961,662 | * | 10/1999 | Yamaguchi et al. | 8/137 |

FOREIGN PATENT DOCUMENTS

| | | | | |
|---|---|---|---|---|
| 92/03525 | * | 3/1992 | (WO) | C11D/1/08 |
| WO 9218594 | | 10/1992 | (WO) . | |
| 94/03572 | * | 2/1994 | (WO) | C11D/3/08 |
| WO 94/03572 | * | 2/1994 | (WO) . | |
| 96/09367 | * | 3/1996 | (WO) | C11D/3/00 |

OTHER PUBLICATIONS

Japanese Abstract: JP–6–500141 A; Jan. 6, 1994.
Japanese Abstract: JP–6–502199 A; Mar. 10, 1994.
Japanese Abstract: JP–7–11292 A; Jan. 13, 1995.

* cited by examiner

*Primary Examiner*—Necholus Ogden
*Assistant Examiner*—Brian P. Mruk
(74) *Attorney, Agent, or Firm*—Birch, Stewart, Kolasch & Birch, LLP

(57) ABSTRACT

The granular detergent composition for clothes washing including a surfactant, a metal ion capturing agent, a crystalline alkali metal silicate, and an acidic ingredient, wherein the granular detergent composition includes at least two different granules: a first granule containing the crystalline alkali metal silicate, and a second granule, which is an acidic granule, containing the acidic ingredient. In the granular detergent composition, the crystalline alkali metal silicate and the acidic ingredient are being present in different granules, and the granular detergent composition shows alkaline property in distilled water at 25° C. and has a bulk density of 650 g/L or more.

Since each of an acidic ingredient and a crystalline alkali metal silicate is included in a different granule, the initial rise in the pH at initial washing can be adjusted, so that a further improved detergency against the sebum dirt stains is exhibited.

13 Claims, 1 Drawing Sheet

GRANULAR DETERGENT COMPOSITION FOR CLOTHING

This application is the national phase under 35 U.S.C. §371 of prior PCT International Application No. PCT/JP97/00749 which has an International filing date of Mar. 10, 1997 which designated the United States of America, the entire contents of which are hereby incorporated by reference.

TECHNICAL FIELD

The present invention relates to a granular detergent composition for clothes washing, comprising one granule containing a crystalline alkali metal silicate and another granule containing an acidic ingredient, the crystalline alkali metal silicate and the acidic ingredient each being contained in different granules, wherein an even more improved detergency against sebum dirt stains can be obtained by adjusting an initial increase in pH at initial washing.

BACKGROUND ART

Generally, heavy-weight detergents have a composition basically comprising a surfactant, an alkalizing agent, and a metal ion capturing agent, wherein the surfactant is added to dissolve dirt stains, the alkalizing agent is added to accelerate the elution of fatty acids which are present in sebum dirt stains, the swelling of fibers, and dispersion of the dirt stains, and the metal ion capturing agent is added to remove water hardness-increasing components, such as calcium and magnesium ions. These detergents may optionally contain other additives such as detergent aids.

More specifically, anionic surfactants including alkylbenzenesulfonates and alkylsulfates, and nonionic surfactants typically exemplified by polyoxyethylene alkyl ethers may be mainly used for base materials of the surfactants. Alkali metal carbonates and alkali metal silicates may be generally used for base materials of the alkalizing agents. Phosphates, aluminosilicates, and polycarboxylates may be generally used for base materials of the metal ion capturing agents. Among these base materials, the phosphorus-containing compounds typically exemplified by tripolyphosphates have been convenient base materials because they are able to act as alkalizing agents and also have excellent metal ion capturing ability. However, the use of tripolyphosphates, etc. may give causes to eutrophication in rivers, lakes, and marshes. Therefore, phosphorus-free detergents using aluminosilicates typically represented by 4A-type ZEOLITE are at present mainly used.

The compositional changes are made, owing to the fact that the aluminosilicates do not have as high a level of an alkalizing ability as the tripolyphosphates, and the deficient alkalizing ability is supplemented by increasing the amounts of the alkali metal carbonates conventionally supplemented as dissolution aids or by increasing the amounts of amorphous alkali metal silicates conventionally added to increase the mechanical strength of the detergent granules or added with an intention to allow it to act as anticorrosive agents.

Crystalline alkali metal silicates disclosed in Japanese Patent Laid-Open Nos. 5-184946 and 60-227895, of which the disclosure is incorporated herein by reference, have not only an alkalizing ability at a level equivalent to or higher than that of the conventional amorphous alkali metal silicates, but also a good metal ion capturing ability, so that they are most closely paid attention as an alternative base material. There are numerous publications disclosing detergent compositions using these crystalline alkali metal silicates, including Japanese Patent Unexamined Publication Nos. 6-507197, 6-500141, and 6-502445 and Japanese Patent Laid-Open No. 7-53992, of which the disclosure is incorporated herein by reference.

Also, for the purposes of controlling pHs and capturing metal ions, there have been proposed in a number of patent applications to include an acid ingredient in the detergent compositions.

For instance, Japanese Patent Laid-Open No. 3-100100, of which the disclosure is incorporated herein by reference, discloses an invention concerning a dishwashing agent comprising a combination of a layered, crystalline alkali metal silicate and a proton donor. However, the purpose of the invention disclosed herein is to reduce the irritation against skin and eyes to which the person in use may be subjected during dishwashing by lowering the pH of the washing liquid, not to improve the detergency against the sebum dirt stains by adjusting an initial rise of the pH at initial washing.

In addition, Japanese Patent Unexamined Publication No. 6-507197, of which the disclosure is incorporated herein by reference, discloses an invention concerning a solid washing detergent composition comprising a uniform mixture of a crystalline alkali metal silicate and a solid water-soluble ionic substance, wherein the crystalline alkali metal silicate and the solid water-soluble ionic substance are contained in particular proportions. Here, it is suggested that both the crystalline alkali metal silicate and the polycarboxylic acid are formulated in the detergent composition. However, the purpose of the invention disclosed herein is to avoid damages to fibers of wool, etc. which are sensitive to alkalis, the damages being caused by a local increase in the pH when the detergent granules containing the crystalline alkali metal silicate are dissolved on clothes. In order to avoid such a problem, the pH is controlled by uniformly blending the crystalline alkali metal silicate with the water-soluble substance capable of forming ions in the same granule in the publication. Also, in this technique, the technical idea that the amount of the acidic ingredient present in a separate granule is not lowered until the instance of introducing detergents is not disclosed, as will be described in detail later, and the acid may be present in the form of salts. Therefore, it does not suggest that remarkable improvements in detergency are achieved by adjusting an initial rise of the pH at the beginning of washing by formulating the acidic ingredient in a granule different from a granule containing the crystalline alkali metal silicate.

Further, Japanese Patent Laid-Open No. 7-48597, of which the disclosure is incorporated herein by reference, discloses an invention concerning a detergent containing a surfactant, a builder, and a polyglycol diacid in particular proportions. However, the invention disclosed herein does not teach that the polyglycol diacid is not formulated in a separate granule from a granule containing the crystalline alkali metal silicate, and the acidic substance is simply added for the purpose of capturing metal ions.

Incidentally, the sebum dirt stains derived from human bodies contain in its most part fatty acids. The most significant effect of the alkalizing agent is to dissolve dirt stains by saponifying the fatty acids in the sebum dirt stains. However, in the presence of the water hardness-increasing components of calcium or magnesium ions in the washing liquid, these components form a scum with the fatty acids, so that its solubility is lowered, thereby preventing the dissolution or dispersion in the dirt-containing washing liquid. In particular, the present inventors have found that higher the degree of alkalization, faster the scum-formation rate, noting that sufficient washing performance cannot be exhibited by the conventional methods when designing detergent compositions using the crystalline alkali metal silicate having a high degree of alkalization.

Accordingly, an object of the present invention is to provide a granular detergent composition for clothes washing with an even superior washing power.

These and other objects of the present invention will be apparent from the following description.

DISCLOSURE OF THE INVENTION

As a result of intense research in view of the above object, the present inventors have found that since an acidic ingredient is formulated in a different granule from the granule containing the crystalline alkali metal silicate in the detergent composition, the crystalline alkali metal silicate being an excellent alkalizing agent showing a high pH, the initial rise in the pH at initial washing can be adjusted, so that a further improved detergency against the sebum dirt stains is exhibited. The present invention has been completed based upon this finding.

Specifically, the present invention is concerned with the following:

(1) A granular detergent composition for clothes washing comprising a surfactant, a metal ion capturing agent, a crystalline alkali metal silicate, and an acidic ingredient, wherein the granular detergent composition comprises at least two different granules:
- a first granule containing the crystalline alkali metal silicate, and
- a second granule, which is an acidic granule, containing the acidic ingredient, the crystalline alkali metal silicate and the acidic ingredient being present in different granules, and wherein the granular detergent composition shows alkaline property in distilled water at 25° C. and has a bulk density of 650 g/L or more;

(2) The granular detergent composition for clothes washing described in item (1) above, wherein the granular detergent composition is usable for water for washing with a water hardness of from 2 to 6° DH, wherein a maximum pH at 25° C. is from 10.70 to 11.50 at a detergent concentration in distilled water of 0.67 g/L;

(3) The granular detergent composition for clothes washing described in item (1) above, wherein the granular detergent composition is usable for water for washing with a water hardness of from 6 to 10° DH, wherein a maximum pH at 25° C. is from 10.70 to 11.50 at a detergent concentration in distilled water of 1.46 g/L;

(4) The granular detergent composition for clothes washing described in (1) above, wherein the granular detergent composition is usable for water for washing with a water hardness of from 10 to 20° DH, wherein a maximum pH at 25° C. is from 10.70 to 11.50 at a detergent concentration in distilled water of 5.33 g/L;

(5) The granular detergent composition for clothes washing described in any one of items (1) to (4) above, wherein the granule containing the crystalline alkali metal silicate is obtained by granulating and/or coating the crystalline alkali metal silicate together with a mixture comprising at least one of surfactants and aluminosilicates;

(6) The granular detergent composition for clothes washing described in item (5) above, wherein the granule containing the crystalline alkali metal silicate is obtained by granulating the crystalline alkali metal silicate together with a surfactant mixture, the surfactant mixture being gelated or solidified on a surface of the crystalline alkali metal silicate;

(7) The granular detergent composition for clothes washing described in item (6) above, wherein one ingredient of the surfactant mixture which is gelated or solidified on the surface of the crystalline alkali metal silicate is a fatty acid or a salt thereof;

(8) The granular detergent composition for clothes washing described in any one of items (1) to (7) above, wherein the acidic granule containing the acidic ingredient is obtained by granulating the acidic ingredient together with a mixture comprising inorganic sulfates or chlorides showing neutral or acidic properties;

(9) The granular detergent composition for clothes washing described in any one of items (1) to (8) above, wherein the acidic granule containing the acidic ingredient contains substantially none of carbonates, hydrogencarbonates, and sulfites;

(10) The granular detergent composition for clothes washing described in any one of items (1) to (9) above, wherein the acidic granule containing the acidic ingredient contains substantially no aluminosilicates;

(11) The granular detergent composition for clothes washing described in any one of items (1) to (10) above, wherein substantially none of carbonates and hydrogencarbonates are contained in any of the granules in the detergent composition;

(12) The granular detergent composition for clothes washing described in any one of items (1) to (11) above, wherein said granular detergent composition comprises:
- (A) 5 to 50% by weight of a surfactant;
- (B) 15 to 60% by weight of a crystalline alkali metal silicate;
- (C) 5 to 50% by weight of a metal ion capturing agent other than components B and D; and
- (D) 0.1 to 20% by weight of an acidic ingredient;

(13) The granular detergent composition for clothes washing described in item (12) above, wherein the weight ratio of component B to component A is B/A=90/10 to 45/55, the weight ratio of component B to component C is B/C=7/93 to 75/25, and the weight ratio of component B to component D is B/D=99/1 to 65/35;

(14) The granular detergent composition for clothes washing described in any one of items (1) to (13) above, wherein crystalline alkali metal silicate has an $SiO_2O/M_2O$ molar ratio of from 0.9 to 2.6, wherein M stands for an element in Group Ia of the Periodic Table;

(15) The granular detergent composition for clothes washing described in item (14) above, wherein the crystalline alkali metal silicate is represented by the following formula (1):

$$xM_2O.ySiO_2.zMe_nO_n.wH_2O, \quad (1)$$

wherein M stands for an element in Group Ia of the Periodic Table; Me stands for one or more elements selected from the group consisting of Groups IIa, IIb, IIIa, IVa, and VIII; y/x is from 0.9 to 2.6; z/x is from 0.01 to 1.0; n/m is from 0.5 to 2.0; and w is from 0 to 20;

(16) The granular detergent composition for clothes washing described in item (14) above, wherein the crystalline alkali metal silicate is represented by the following formula (2):

$$M_2O.x'SiO_2.y'H_2O, \quad (2)$$

wherein M stands for an element in Group Ia of the Periodic Table; x' is from 1.5 to 2.6; and y' is from 0 to 20;

(17) The granular detergent composition for clothes washing described in any one of items (1) to (16) above, wherein the acidic ingredient has two or more carboxyl groups in a molecule;

(18) The granular detergent composition for clothes washing described in item (17) above, wherein the acidic ingredient is a non-neutralized polymer or a partially neutralized polymer, the polymer being obtained by polymerizing carboxylic acid monomers;

(19) The granular detergent composition for clothes washing described in item (18) above, wherein the polymer is obtained by polymerizing one or more monomers selected from the group consisting of acrylic acid, methacrylic acid, and maleic acid;

(20) The granular detergent composition for clothes washing described in item (18) or item (19) above, wherein the degree of neutralization of the polymer used as the acidic ingredient is from 0 to 50% by mol;

(21) The granular detergent composition for clothes washing described in any one of items (1) to (20) above, wherein a nonionic surfactant is contained in an amount of 50% by weight or more of an entire surfactant component;

(22) The granular detergent composition for clothes washing described in item (21) above, wherein the nonionic surfactant is a polyoxyethylene alkyl ether;

(23) The granular detergent composition for clothes washing described in any one of items (1) to (22) above, wherein the granule containing the crystalline alkali metal silicate contains a surfactant, a crystalline alkali metal silicate, and an aluminosilicate, and wherein the acidic granule containing the acidic ingredient contains an acidic ingredient and inorganic salts other than carbonates, hydrogencarbonates, and sulfites;

(24) The granular detergent composition for clothes washing described in any one of items (1) to (23) above, wherein a maximum pH of a washing liquid is maintained at a level of 10.3 or higher in a case where washing is carried out by using the washing liquid containing the granular detergent composition in an amount of from 14 to 25 g per 30 liters in water for washing;

(25) In a process for washing clothes utilizing a detergent composition, the improvement for which comprises using a composition described in any one of items (1) to (24) as a detergent composition; and

(26) Use of a composition described in any one of items (1to (24) as a detergent composition for washing clothes.

Figure 2:
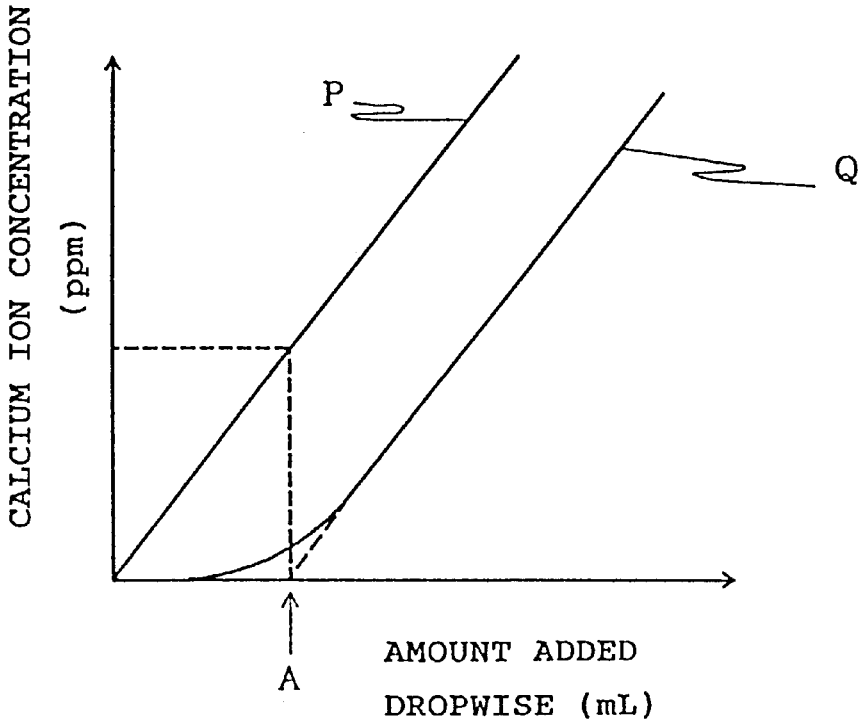
FIG. 2 is a graph showing the relationships between the amount of the $CaCl_2$ aqueous solution added dropwise and the calcium ion concentration.

The reference numerals in FIG. 2 are as follows:

A is an intersection of the extension of the linear portion of Line Q with the abscissa (horizontal axis); P shows the data of the blank solution (buffer solution without using the chelating agent); and Q shows the data for the chelating agent-containing buffer solution.

BEST MODE FOR CARRYING OUT THE INVENTION

The present invention is concerned with a granular detergent composition for clothes washing comprising a surfactant, a metal ion capturing agent, a crystalline alkali metal silicate, and an acidic ingredient, wherein the granular detergent composition comprises at least two different granules:

a first granule containing the crystalline alkali metal silicate, and a second granule, which is an acidic granule, containing the acidic ingredient, the crystalline alkali metal silicate and the acidic ingredient being present in different granules, and wherein the granular detergent composition shows alkaline property in distilled water at 25° C. and has a bulk density of 650 g/L or more.

When the crystalline alkali metal silicate and the acidic ingredient are present in the same granule without subjecting them to any treatments, the neutralization reaction proceeds within the granule, so that the amount of the acidic ingredient is likely to be lowered. Therefore, it would be impossible to adjust an initial rise in pH at the beginning of washing with small amounts of acids. Moreover, in addition to the above, the neutralization reaction between the crystalline alkali metal silicate and the acidic ingredient is likely to cause to break the crystalline structure showing a high alkalizing ability owned by the crystalline alkali metal silicates, so that the maximum pH (pH when dissolved completely) is not likely to be at a desirably high level and the deterioration of the metal ion capturing ability becomes drastically large. For the above reasons, the crystalline alkali metal silicate and the acidic ingredient should be contained in different granules.

Accordingly, the granular detergent composition of the present invention comprises at least two different granules:

a first granule containing the crystalline alkali metal silicate; and a second granule, which is an acidic granule containing the acidic ingredient.

Here, the granular detergent composition is prepared by after-blending the granule containing the crystalline alkali metal silicate and the acidic granule containing the acidic ingredient as completely separate granules, each of the ingredients being contained in different granules in the detergent composition.

The granular detergent composition for clothes washing of the present invention shows alkaline property in distilled water at 25°C. Here, it is preferred that a maximum pH in a typical standard concentration of the detergent in the washing liquid at 25° C. is from 10.70 to 11.50, more preferably from 10.85 to 11.30. The typical standard concentration of the detergent depends on the water hardness of the water used for washing. The maximum pH is preferably 10.70 or higher from the aspect of achieving sufficient level of alkaline property for washing off sebum dirt stains. The maximum pH is preferably 11.50 or lower from the aspect of obtaining sufficient detergency in the presence of the water hardness-increasing components.

The standard concentration of the detergent of the detergents in water for washing greatly differs throughout the world. This is owing to the differences in the water hardness of tap water in each of the countries. For instance, while the tap water has a water hardness of usually around 4° DH in Japan, the tap water has a water hardness of not less than 6° DH in the U.S., and that exceeding 10° DH in European countries is used for the water for washing. Therefore, since the required absolute amount of the metal ion capturing agents varies, the standard concentration would be optimally adjusted accordingly.

Accordingly, since the standard concentration differs depending upon the water hardness of the water for washing, there are the following embodiments in the present invention:

1) The granular detergent composition is usable for water for washing with a water hardness of from 2 to 6° DH, wherein a maximum pH of the washing liquid at 25° C. is from 10.70 to 11.50 in a detergent concentration in distilled water of 0.67 g/L;
2) The granular detergent composition is usable for water for washing with a water hardness of from 6 to 10° DH, wherein a maximum pH of the washing liquid at 25° C. is from 10.70 to 11.50 in a detergent concentration in distilled water of 1.46 g/L; and
3) The granular detergent composition is usable for water for washing with a water hardness of from 10 to 20° DH, wherein a maximum pH of the washing liquid at 25° C. is from 10.70 to 11.50 in a detergent concentration in distilled water of 5.33 g/L.

Here, the term "maximum pH of the washing liquid" in the present invention means the maximum pH value of the washing liquid obtained by adding a given detergent composition to make it in a given concentration in distilled water at 25° C. under conditions that washing items are absent in the detergent solution. Specifically, the maximum pH is measured as follows. A given amount of the granular detergent composition is added and stirred in one liter of distilled water at 25° C., and the pH of the solution is measured using such devices as a conventional glass electrode pH meter.

Also, the DH water hardness is measured by an ion coupling plasma method (ICP method).

The granular detergent composition for clothes washing of the present invention has a bulk density of 650 g/L or more, preferably from 700 to 1000 g/L.

The crystalline alkali metal silicate usable in the present invention has an average particle size preferably of 100 μm or less, more preferably from 1 to 60 μm. From the aspect of preventing the lowering of the alkalizing speed or the ion exchange speed and consequently preventing the lowering of the detergency, the average particle size of the crystalline alkali metal silicate is preferably 100 μm or less.

Also, the granule containing crystalline alkali metal silicate preferably has an average particle size of from 150 to 1000 μm, more preferably from 300 to 600 μm. Particularly when the average particle size of the granule is 600 μm or less, the dissolution or dispersibility of the granule is good, thereby making it possible to achieve good detergency. On the other hand, when the average particle size is 150 μm or more, the neutralization reaction between the granule containing the crystalline alkali metal silicate and the acidic granule containing the acidic ingredient are likely to be prevented, and consequently, the effects of the present invention are not likely to be spoiled. This is because the contact area of the granule containing the crystalline alkali metal silicate and the acidic granule is made larger by the reduction in the particle size of the granule containing the crystalline alkali metal silicate. Incidentally, the average particle size referred herein is a median diameter obtained from a particle size distribution.

Also, it is preferred that the granule containing the crystalline alkali metal silicate is obtained by granulating and/or coating the crystalline alkali metal silicate together with such components as surfactants and aluminosilicates, rather than that obtained by using the crystalline alkali metal silicate without any treatments, from the viewpoints of preventing the neutralization reaction during storage or and of adjusting the initial rise of pH at the beginning of washing.

In one method, the granule containing the crystalline alkali metal silicate is obtained by granulating together with a surfactant mixture, the surfactant mixture being gelated or solidified on a surface of the crystalline alkali metal silicate. Preferable are those gelated or solidified by mixing with a nonionic surfactant described below. Particularly, a preferred example of surfactant mixtures include a mixture of a nonionic surfactant and an anionic surfactant capable of having a lamellar orientation. Most preferable embodiment is where one component of the solidified surfactant mixture is a fatty acid or a salt thereof. For instance, the anionic surfactant is added in the form of acids and blended with the nonionic surfactants, and the fatty acids are neutralized with the crystalline alkali metal silicates to form salts on the surface of the alkali metal silicates. Examples of the nonionic surfactants, the anionic surfactants, and the fatty acids are given later.

The acidic granule containing the acidic ingredient in the present invention shows preferably an acidic property in distilled water at 25° C. More specifically, examples thereof include those having a pH in distilled water at 25° C. of 5.5 or lower at acidic granule concentration of equal to one-quarter the concentration of the standard concentration of the detergent. The pH is preferably 5.5 or lower, from the viewpoint of achieving sufficient effects ascribed to the acidic granule in the present invention.

In the present invention, the acidic granule containing the acidic ingredient may comprise the acidic ingredient alone, whose examples are mentioned later, or the acidic granule may be obtained by granulating the acidic ingredient together with a mixture comprising an inorganic sulfate or chloride showing neutral and acidic properties. The average particle size of the acidic granule is preferably from 150 to 1000 μm, more preferably from 300 to 600 μm. The average particle size of the acidic granule is preferably 1000 μm or less from the viewpoint of maintaining good speed for exhibiting acidic property, thereby achieving excellent effects ascribed to the acidic granule. The average particle size is preferably 150 μm or more, from the viewpoint of preventing the neutralization reaction of the acidic granule with the granule containing the crystalline alkali metal silicate during storage. When the acidic ingredient has a relatively large particle size, it may be used as the acid granule without any further treatments. Alternatively, the acidic ingredient may be granulated with such binders as polyethylene glycols and nonionic surfactants. In addition, the acidic granule may be those prepared by a spray-drying method or a freeze-drying method, or the granules obtained by the above drying methods may be further subjected to a granulation treatment.

The preparation methods for the acidic granule containing the acidic ingredient may be referred to the method of Japanese Patent Laid-Open No. 5-209200, of which the disclosure is incorporated herein by reference, provided that an alkalizing agent is included in a granule different from that containing the acidic ingredient.

Since the acidic granule is prepared by subjecting the acidic ingredient to such treatments mentioned above with a binder, not only the contact between the alkali components and the acid ingredients can be avoided, but also the alkalizing speed can be controlled, so that the sebum dirt stain removability can be further improved.

In the present invention, it is preferred that the acidic granule containing the acidic ingredient includes substantially none of carbonates, hydrogencarbonates, and sulfites. More preferably, substantially none of carbonates and hydrogencarbonates are included in any of granules in the detergent composition. This is because its effects as the acidic ingredient is greatly lost by reaction between the acidic ingredient and these compounds. Also, a $CO_2$ gas or a sulfurous acid gas is gradually generated, so that the commercial values of the detergent product are notably lowered owing to the bulging of the carton packages.

As described above, in the present invention, a solid phase-solid phase reaction within a granule must be prevented. By contrast, Japanese Patent Unexamined Publication No. 6-507197 mentioned above teaches that the alkalizing activity of the crystalline alkali metal silicate is lowered by the solid phase-solid phase reaction between the crystalline alkali metal silicate and the acidic ingredient by providing a uniform mixture in the granule, which has a purpose completely different from that of the present invention. This difference is made apparently obvious from the difference in the purposes of blending carbonates. In other words, in a case where a carbonate and the acidic ingredient are coexistent in one granule, if these components are formed into one granule without subjecting at least one of the carbonates and the acidic ingredient to such treatments as coating, a $CO_2$ gas generates by the solid phase-solid phase reaction, thereby causing a significant problem in the powder properties. However, this publication teaches a positive, uniform blending of the carbonates, suggesting that there is a higher priority in the solid phase-solid phase reaction between the acidic ingredient and the crystalline alkali metal silicate over the solid phase-solid phase reaction between the acidic ingredient and the carbonates. In other words, the purpose of the publication is to prevent a locally drastic increase of pH just after introducing detergents, which never teaches that the amount of the acidic ingredient present in a separate granule is not lowered until the instance of introducing detergents. This point is clearly apparent from claim 1 of the publication where the organic acids and the carbonates are listed as alternatives in one group. On the other hand, in the present invention, it is very important that the amount of the acidic ingredient present in a separate granule is not lowered until the instance of introducing detergents, and it is preferred that as little carbonates as possible are to be contained in the detergent composition because they are highly likely to generate a $CO_2$ gas.

Also, when an aluminosilicate is present in the acidic granule, neutralization reaction between the acid ingredient and the aluminosilicate proceeds, so that not only the amount of the acidic ingredient is lowered upon storing the detergent composition, but also the ionexchange capacity of the aluminosilicates is lowered. Therefore, the acidic granule may contain the aluminosilicates in an amount of preferably 5% by weight or less. More preferably, the acidic granule contains substantially no aluminosilicates.

The granular detergent composition for clothes washing of the present invention comprises (A) a surfactant, (B) a crystalline alkali metal silicate, (C) a metal ion capturing agent other than components B and D, and (D) an acidic ingredient, wherein each of the components is preferably contained in the following proportions in the entire composition:

| | |
|---|---|
| (A) a surfactant | 5 to 50% by weight; |
| (B) a crystalline alkali metal silicate | 15 to 60% by weight; |
| (C) a metal ion capturing agent other than components B and D | 5 to 50% by weight; and |
| (D) an acidic ingredient | 0.1 to 20% by weight. |

More preferably, each of the components is contained in the following proportions in the entire composition:

| | |
|---|---|
| (A) a surfactant | 7 to 30% by weight; |
| (B) a crystalline alkali metal silicate | 20 to 50% by weight; |
| (C) a metal ion capturing agent other than components B and D | 10 to 45% by weight; and |
| (D) an acidic ingredient | 1 to 12% by weight. |

Also, as for the compositional ratio of each of the above components, it is preferred that the weight ratio of component B to component A is B/A=90/10 to 45/55, the weight ratio of component B to component C is B/C=7/93 to 75/25, and the weight ratio of component B to component D is B/D=99/1 to 65/35. More preferably, the B/A is 90/10 to 50/50, the B/C is 7/93 to 67/33, and the B/D is 90/10 to 75/25. Most preferred ranges for B/C are as follows: In a case where the water hardness of the water for washing is 2 to 6° DH, B/C is from 30/70 to 67/33; in a case where the water hardness of the water for washing is 6 to 10° DH, B/C is from 14/86 to 57/43; and in a case where the water hardness of the water for washing is 1°° DH or higher, B/C is from 7/93 to 50/50.

In the present invention, it is preferred that the granular detergent composition having the above-mentioned composition can be suitably exhibited from the viewpoint of the addition effects of the acidic ingredient.

Also, in the present invention, it is preferred that the granule containing the crystalline alkali metal silicate contains a surfactant, a crystalline alkali metal silicate, and an aluminosilicate, and that the acidic granule contains an acidic ingredient and inorganic salts other than carbonates, hydrogencarbonates, and sulfites.

Each of the components will be explained in detail below.

(A) Surfactant

The surfactants usable in the present invention are not particularly limited, and any ones generally used for detergents are used, in which a nonionic surfactant is preferably contained in an amount of from 50% by weight or more, more preferably from 50 to 100% by weight, particularly from 65 to 100% by weight, of the entire surfactant. Specifically, they may be one or more surfactants selected from the group consisting of nonionic surfactants, anionic surfactants, cationic surfactants, and amphoteric surfactants, each being exemplified below. For instance, the surfactants can be chosen such that the surfactants of the same kind are chosen, as in the case where a plurality of the nonionic surfactants are chosen. Alternatively, the surfactants of the different kinds can be chosen, as in the case where the anionic surfactant and the nonionic surfactant are respectively chosen.

Examples of the nonionic surfactants are as follows:

Polyoxyethylene alkyl ethers, polyoxyethylene alkylphenyl ethers, polyoxyethylene sorbitan fatty acid esters, polyoxyethylene sorbitol fatty acid esters, polyoxyethylene fatty acid esters, polyoxyethylene polyoxypropylene alkyl ethers, polyoxyethylene castor oils, polyoxyethylene alkylamines, glycerol fatty acid esters, higher fatty acid alkanolamides, alkylglycosides, alkylglucosamides, and alkylamine oxides.

Among the nonionic surfactants, a particular preference is given to polyoxyethylene alkyl ethers from the viewpoint of detergency. It is more desired that the polyoxyethylene alkyl ethers are ethylene oxide adducts whose alkyl moieties are ascribed to linear or branched, primary or secondary alcohols, each having 10 to 18 carbon atoms, and whose ethylene oxide moieties have an average molar number of 4 to 12, and still more desired that polyoxyethylene alkyl ethers which are ethylene oxide adducts whose alkyl moieties are linear or branched, primary or secondary alcohols, each having 12 to 14 carbon atoms, and whose ethylene oxide moieties have an average molar number of 5 to 10.

Examples of the anionic surfactants include alkylbenzenesulfonates, alkyl or alkenyl ether sulfates, alkyl or alkenyl sulfates, α-olefinsulfonates, α-sulfofatty acid salts, α-sulfofatty acid ester salts, alkyl or alkenyl ether carboxylates, amino acid-type surfactants, and N-acyl amino acid-type surfactants, with a preference given to alkylbenzenesulfonates, alkyl or alkenyl ether sulfates, alkyl or alkenyl sulfates, and metal soaps.

Examples of the cationic surfactants include quaternary ammonium salts, such as alkyltrimethylammonium salts. Examples of the amphoteric surfactants include carboxy-type and sulfobetaine-type amphoteric surfactants.

(B) Crystalline Alkali Metal Silicates

The crystalline alkali metal silicate usable in the present invention preferably has such an alkalizing ability, to a level that its maximum pH value is 11.0 or more at 25° C. in a 0.1% by weight dispersion, and that it takes 5 ml or more of a 0.1 N HCl aqueous solution to lower its pH to 10 in one liter of the above dispersion.

In the present invention, the crystalline alkali metal silicate having an $SiO_2/M_20$ molar ratio of 0.9 to 2.6, wherein M stands for an element in Group Ia of the Periodic Table, is preferable usable.

Among the crystalline alkali metal silicates usable in the present invention, a preference is given to those having the following compositions:

$$xM_2O.ySiO_2.zMe_mO_n.wH_2O, \quad (1)$$

wherein M stands for an element in Group Ia of the Periodic Table; Me stands for one or more members selected from the group consisting of elements in Groups IIa, IIb, III*a*, IV*a*, and VIII; y/x is from 0.9 to 2.6; z/x is from 0.01 to 1.0; n/m is from 0.5 to 2.0; and w is from 0 to 20.

$$M_2O.x'SiO_2.y'H_2O, \quad (2)$$

wherein M stands for an element in Group Ia of the Periodic Table; x' is from 1.5 to 2.6; and y' is from 0 to 20.

First, the crystalline alkali metal silicates having the composition (1) above will be detailed below.

In the general formula (1), M stands for an element selected from elements in Group Ia of the Periodic Table, wherein the Group Ia elements may be exemplified by Na, K, etc. The Group Ia elements may be used alone, or in combination of two or more kinds. For instance, such compounds as $Na_2O$ and $K_2O$ may be mixed to constitute an $M_2O$ component.

Me stands for one or more members selected from the group consisting of elements in Group IIa, IIb, IIIa, IVa, and VIII of the Periodic Table, and examples thereof include Mg, Ca, Zn, Y, Ti, Zr, and Fe, which are not particularly limited to the above examples. Here, a preference is given to Mg and Ca from the viewpoint of resource stock and safety. In addition, these elements may be used alone, or in combination of two or more kinds. For instance, such compounds as MgO and CaO may be mixed to constitute an $Me_mO_n$ component.

In addition, the crystalline alkali metal silicates in the present invention may be in the form of hydrates, wherein the amount of hydration (w) is usually in the range of from 0 to 20 moles of $H_2O$.

With respect to the general formula (1), y/x is from 0.5 to 2.6, preferably from 1.5 to 2.2. From the aspect of anti-solubility in water, y/x is preferably 0.9 or more. Also, from the aspect of sufficiently functioning as an alkalizing agent and an ion exchange material, y/x is preferably 2.6 or less. When the anti-solubility in water is insufficient, powder properties of the detergent composition, such as caking properties, solubility, etc. are drastically lowered.

With respect to z/x, it is from 0.01 to 1.0, preferably from 0.02 to 0.9, more preferably from 0.02 to 0.5. From the aspect of the anti-solubility in water, z/x is preferably 0.01 or more, and from the aspect of the ion exchange capacity, z/x is preferably 1.0 or less.

With respect to x, y and z, there are no limitations, as long as y/x and z/x have the above relationships. When $xM_2O$, for example, is $x'Na_2O.x''K_2O$ as described above, x equals to x'+x". The same can be said for z when $zMe_mO_n$ comprises two or more components. Further, "n/m is from 0.5 to 2.0" indicates the number of oxygen ions coordinated to the above elements, which actually takes values selected from 0.5, 1.0, 1.5, and 2.0.

The above crystalline alkali metal silicate preferably has an ion exchange capacity of 100 $CaCO_3$ mg/g or more, more preferably from 200 to 600 $CaCO_3$ mg/g. Therefore, the crystalline alkali metal silicate is one of the materials having metal ion capturing ability in the present invention.

Next, the crystalline alkali metal silicates having the composition (2) above will detailed below.

These crystalline alkali metal silicates are represented by the general formula (2):

$$M_2O.x'SiO_2.y'H_2O, \quad (2)$$

wherein M stands for an element in Group Ia of the Periodic Table; x' is from 1.5 to 2.6; and y' is from 0 to 20.

Among them, a preference is given to the crystalline alkali metal silicates having x' and y' in the general formula (2) such that each satisfies $1.7 \leqq x' \leqq 2.2$ and y'=0. Here, the crystalline alkali metal silicate has such a metal ion capturing ability that those having cationic exchange capacity is preferably 100 $CaCO_3$ mg/g or more, more preferably from 200 to 400 $CaCO_3$ mg/g, are usable.

A method for producing the above crystalline alkali metal silicates is disclosed in Japanese Patent Laid-Open No. 60-227895. The crystalline alkali metal silicates may be generally produced by baking glassy amorphous sodium silicate at a temperature of from 200 to 1000° C. Also, the crystalline alkali metal silicates are commercially available in powdery or granular forms under a trade name "Na-SKS-6" (δ-$Na_2Si_2O_5$) (manufactured by Hoechst).

In the present invention, the crystalline alkali metal silicate having the composition (1) and the crystalline alkali metal silicate having the composition (2) may be used alone or in combination.

(C) Metal Ion Capturing Agents Other Than Components B and D

In the present invention, the metal ion capturing agents may be preferably blended in an amount sufficient to lower the water hardness in a desired degree. As for the metal ion capturing agent, any of those metal ion capturing agents which are usually used in detergents other than the alkali metal silicates constituting component B and the acidic ingredients constituting component D are usable. The metal ion capturing agents constituting component C other than the alkali metal silicates constituting component B and the acidic ingredients constituting component D means those having a calcium ion capturing ability of 100 $CaCO_3$ mg/g or higher, with a preference given to those having a calcium ion capturing ability of 200 $CaCO_3$ mg/g or higher.

In particular, a preference is given to an aluminosilicate having the following formula (3):

$$x''(M_2O).Al_2O_3.y''(SiO_2).w''(H_2O), \quad (3)$$

wherein M stands for an alkali metal atom, such as sodium atom or potassium atom; x", y", and w" each stands for a molar number of each component, wherein, generally, x" is from 0.7 to 1.5; y" is from 0.8 to 6; and w" is from 0 to 20.

The aluminosilicates mentioned above may be crystalline or amorphous, and among the crystalline aluminosilicates, a particular preference is given to those having the following general formula:

$$Na_2O.Al_2O_3.ySiO_2.wH_2O,$$

wherein y is a number of from 1.8 to 3.0; and w is a number of from 1 to 6.

As for the crystalline aluminosilicates (zeolites), synthetic zeolites having an average, primary particle size of from 0.1 to 10 $\mu$m, which are typically exemplified by A-type zeolite, X-type zeolite, and P-type zeolite, are suitably used. The zeolites may be used in the forms of powder and/or a zeolite slurry, or dried particles comprising zeolite agglomerates obtained by drying the slurry.

The above crystalline aluminosilicates are obtainable by conventional methods. For instance, methods disclosed in Japanese Patent Laid-Open Nos. 50-12381 and 51-12805, of which the disclosures are incorporated herein by reference, may be employed.

On the other hand, the amorphous aluminosilicates represented by the same general formula as the above crystalline aluminosilicate have lower ion exchange capacity when compared with that of the crystalline aluminosilicate, and they may be suitably used when using liquid-state materials, such as nonionic surfactants.

By this method, the oil-absorbing amorphous aluminosilicate carrier having an ion exchange capacity of 100 $CaCO_3$ mg/g or more and an oil-absorbing capacity of 80 ml/100 g or more can be easily obtained (see Japanese Patent Laid-Open Nos. 62-191417 and 62-191419, of which the disclosures are incorporated herein by reference).

Also, among the carboxylate polymers, those having a degree of neutralization of carboxyl groups in a molecule exceeding 70% are not considered as an acidic ingredient usable in the present invention which will be described later. However, the carboxylate polymers having high degree of neutralization may be included in any of the acidic granule or the granule containing the crystalline alkali metal silicate. The chemical structures may be the same as those described for the acidic ingredient described later, and those which are unstable as acids, such as polyacetal carboxylic acid polymers as those disclosed, for instance, in Japanese Patent Laid-Open No. 54-52196 are used in the form of salts. As a matter of course, the carboxylate polymers used for an acidic ingredient also act as metal ion capturing agents, and they may be counted as the metal ion capturing agents. In the present invention, in the case where the acidic ingredient at the same time function as a metal ion capturing agent as described above, in the detergent composition, it is considered as a metal ion capturing agent in an amount calculated as an Na salt with 100% degree of neutralization. In the present invention, it is desired that those granules showing acidic properties are included. When the carboxylate polymer and the acidic ingredient are formed into one granule, components other than the acidic ingredient are not particularly limited.

Examples of the other metal ion capturing agents than those mentioned above include aminotri (methylenephosphonic acid), 1-hydroxyethylidene-1,1-diphosphonic acid, ethylenediaminetetra (methylenephosphonic acid), diethylenetriaminepenta (methylenephosphonic acid), and salts thereof; salts of phosphonocarboxylic acids, such as salts of 2-phosphonobutane-1,2-dicarboxylic acid; amino acid salts, such as salts of aspartic acid and salts of glutamic acid; aminopolyacetates, such as nitrilotriacetates and ethylenediaminetetraacetates.

(D) Acidic Ingredients

The acidic ingredient in the present invention refers to those having acidic properties when dissolved in distilled water.

The acidic ingredients usable herein are preferably organic acids rather than inorganic acids, with a particular preference given to those having two or more carboxyl groups in a molecule. Specific preferred examples include low-molecular compounds, such as citric acid, succinic acid, malic acid, fumaric acid, maleic acid, ethylenediaminetetraacetic acid, glutaric acid, malonic acid, oxalic acid, and tartaric acid; and non-neutralized polymers and partially neutralized polymers, the polymers being obtainable by polymerizing carboxylic acid monomers, with a particular preference given to the polymers having degree of neutralization of 0 to 50% by mol.

Examples of the above polymers include polymers or copolymers, each having repeating units represented by the general formula (4):

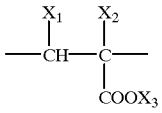

(4)

wherein $X_1$ stands for a methyl group, a hydrogen atom, or a $COOX_3$ group; $X_2$ stands for a methyl group, a hydrogen atom, or a hydroxyl group; $X_3$ stands for a hydrogen atom, an alkali metal ion, an alkaline earth metal ion, an ammonium ion, or 2-hydroxyethylammonium ion.

In the general formula (4), examples of the alkali metal ions include Na, K, and Li ions, and examples of the alkaline earth metal ions include Ca and Mg ions.

Examples of the polymers or copolymers usable in the present invention include those obtainable by polymerization reactions of acrylic acid, (anhydrous) maleic acid, methacrylic acid, $\alpha$-hydroxyacrylic acid, crotonic acid, isocrotonic acid, and salts thereof; copolymerization reactions of each of the monomers; or copolymerization reactions of the above monomers with other copolymerizable monomers. Here, examples of the other copolymerizable monomers used in copolymerization reaction include aconitic acid, itaconic acid, citraconic acid, fumaric acid, vinyl phosphonic acid, sulfonated maleic acid, diisobutylene, styrene, methyl vinyl ether, ethylene, propylene, isobutylene, pentene, butadiene, isoprene, vinyl acetate (vinyl alcohols in cases where hydrolysis takes place after copolymerization), and acrylic acid ester, without particularly being limited thereto.

Among the above polymers, those obtainable by polymerizing one or more monomers selected from acrylic acid, methacrylic acid, and maleic acid are still more preferred from the aspect of not only satisfying the washing effects against sebum dirt stains but also giving good dispersibility of dirt stains. Incidentally, the polymerization reactions are not particularly limited, and any of the conventionally known methods may be employed.

In the present invention, the above polymers and copolymers preferably have a weight-average molecular weight of from 800 to 1,000,000, more preferably from 5,000 to 200,000.

Also, in the case of copolymers, although the copolymerization ratios between the repeating units of the general formula (4) and other copolymerizable monomers are not particularly limited, a preference is given to copolymerization ratios of the repeating units of general formula (4)/other copolymerizable monomer=1/100 to 90/10.

The acidic ingredients usable in the present invention may be those having a metal ion capturing ability. However, in the present specification, among the above polymers, those not showing acidic properties defined as above are counted as component C, and those having acidic properties are counted as component D.

Here, the methods for measuring the ion capturing capability of the metal ion capturing materials depend upon whether the ion exchange materials or the chelating agents are used for the metal ion capturing materials. The measurement methods for each of the materials are given below.

Ion Exchange Material

The amount 0.1 g of an ion exchange material is accurately weighed and added to 100 ml of a calcium chloride aqueous solution (500 ppm concentration, when calculated as $CaCO_3$), followed by stirring at 25° C. for 60 minutes. Thereafter, the mixture is filtered using a membrane filter (made of nitrocellulose; manufactured by Advantech) with 0.2 $\mu$m pore size. The amount 10 ml of the filtrate is assayed for Ca content by an EDTA titration, and the calcium ion exchange capacity (cationic exchange capacity) of the ion exchange material is calculated from the titer.

Chelating Agent

The calcium ion capturing capacity of the chelating agent is measured by the following method using a calcium ion electrode. Incidentally, the solution used herein is prepared with the following buffer solution:

Buffer: 0.1 M—$NH_4Cl$—$NH_4OH$ buffer (pH 10.0)

(i) Preparation of Calibration Curve

Figure 1:
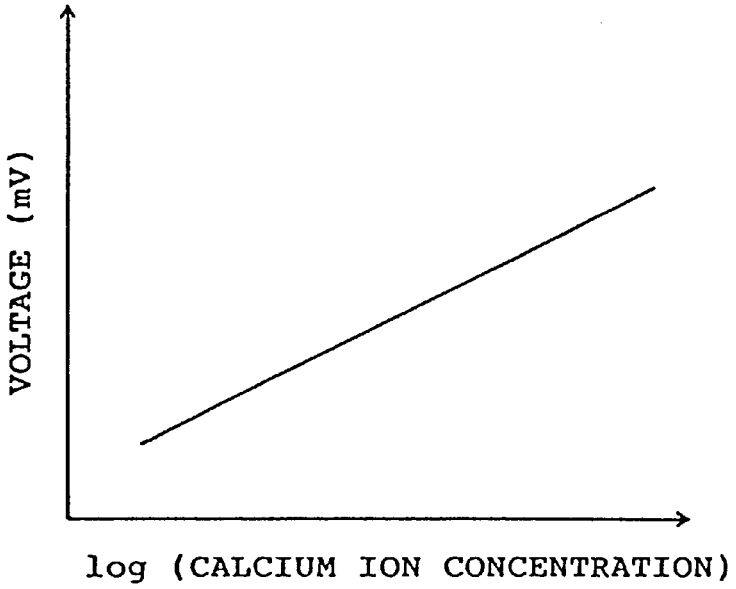
FIG. 1 is a graph of a calibration curve showing the relationship between the logarithm of the calcium ion concentration and the voltage.

A standard calcium ion solution is prepared to draw up a calibration curve showing the relationships between the logarithm of the calcium ion concentration and the voltage, as shown in FIG. 1.

(ii) Measurement of Calcium Ion Capturing Capacity

About 0.1 g of a chelating agent is weighed, and a 100 ml volumetric flask is charged with the chelating agent. The volumetric flask is filled up to a volume of 100 ml with the above buffer solution. A $CaCl_2$ aqueous solution (pH 10.0) having a calcium ion concentration of 20,000 ppm calculated as $CaCO_3$ is added dropwise from a burette. The dropwise addition is made in an amount of 0.1 to 0.2 ml to obtain each voltage reading. Also, the buffer solution without containing the chelating agent is also subjected to the same dropwise treatment of the $CaCl_2$ aqueous solution. This solution is called a "blank solution." Thus, a calcium ion concentration is calculated from the calibration curve given in FIG. 1 by taking a voltage reading. The relationship between the amount of the $CaCl_2$aqueous solution added dropwise and the calcium ion concentration is shown in a graph (FIG. 2). In FIG. 2, Line P shows the data of the blank solution (buffer solution without using the chelating agent), and Line Q shows the data for the chelating agent-containing buffer solution. The point where the extension of the linear portion of Line Q intersects with the abscissa (horizontal axis) is called "A." The calcium ion capturing capacity of the chelating agent is obtained from the calcium ion concentration at "A" of the blank solution.

Also, in the present invention, since the acidic ingredient is added as a separate granule from the granule containing the crystalline alkali metal silicate, it is possible to maintain the washing liquid at a high pH, thereby making it less likely to be affected by the dirt stains of clothes or by the water hardness-increasing components. Therefore, it is preferred that the pH of the washing liquid is maintained at a level of 10.3 or higher in a case where washing is carried out by using the washing liquid containing the granular detergent composition in an amount of from 14 to 25 g per 30 liters of a water for washing, for which the water hardness is 2 to 6° DH.

Examples of other ingredients which may be optionally added to the granular detergent composition of the present invention include various salts including alkali metal salts of sulfates, chlorides, carbonates, amorphous alkali metal silicates, and sulfites, and organic amines, such as alkanolamines. However, as mentioned above, it is preferred that the granular detergent composition substantially contains none of the carbonates and the sulfites.

In addition, color-fading preventives and anti-redeposition agents generally blended in detergent compositions, including non-dissociating polymers such as polyethylene glycols, polyvinyl alcohols, and polyvinyl pyrrolidones; organic acid salt builders, such as diglycolates and hydroxycarboxylates; and carboxymethyl cellulose may be optionally used.

Besides the above, the following ingredients may be also contained in the granular detergent composition of the present invention. For instance, caking preventives, such as lower alkylbenzenesulfonates whose alkyl moieties have about 1 to 4 carbon atoms, sulfosuccinates, talc, and calcium silicates; and antioxidants, such as tert-butylhydroxytoluene and distyrenated cresol, may be used together with stilbene-type and biphenyl-type fluorescent dyes as in conventional methods. Also, blueing agents may be added, and perfumes suitable for high-bulk density detergents disclosed in Japanese Patent Laid-Open Nos. 63-101496 and 5-202387, of which the disclosures are incorporated herein by reference, may be also added. The kinds and use of these optional ingredients are not particularly limited thereto. Besides them, enzymes, such as proteases, lipases, cellulases, and amylases; bleaching agents, such as sodium percarbonate; bleaching activators, such as tetraacetyl ethylenediamine may be dry-blended as separate, third granules in the detergent composition of the present invention. The optional ingredients are not particularly limited, and they may be blended so as to give desired compositions suitable for their purposes.

The granular detergent compositions of the present invention may contain each of the components described above.

An exception is given to the preparation method of the acidic granule containing an acidic ingredient, the granules may be produced without particular limitation by referring to the conventionally known methods. Examples of the methods for producing high-bulk density detergents include the methods disclosed in Japanese Patent Laid-Open Nos. 61-69897, 61-69899, 61-69900, 5-209200, and DE19529298, of which the disclosures are incorporated herein by reference. In addition, a method for obtaining a detergent composition with an even higher bulk density may be referred to WO95/26394, of which the disclosure is incorporated herein by reference. Incidentally, a detergent composition may be prepared by blending as a separate third granule containing enzymes, bleaching agents, bleaching activators, defoaming agents, etc. Also, a detergent composition may be prepared by excluding other metal ion capturing agents such as zeolites from the granules including the crystalline alkali metal silicate and blending a third granule obtained by granulating these other metal ion capturing agents as a separate granule with first and second granules.

The present invention will be further described in detail by means of following working examples, without intending to restrict the scope of the present invention thereto.

Preparation Example 1

(Crystalline Alkali Metal Silicate A)

55.9 parts by weight of sodium hydroxide and 8.5 parts by weight of potassium hydroxide were added to 1000 parts by weight of No. 2 sodium silicate ($SiO_2$/Na2O (molar ratio)= 2.5), and the components were stirred using a homomixer to dissolve sodium hydroxide and potassium hydroxide. To the above mixture, 5.23 parts by weight of finely dispersed anhydrous calcium carbonate and 0.13 parts by weight of magnesium nitrate hexahydrate were added and mixed using the homomixer. A given amount of the resulting mixture was transferred into a nickel crucible and baked in the air at a temperature of 700° C. for one hour, and then the baked product was rapidly cooled. The resulting baked product was pulverized, to give powder of Crystalline Alkali Metal Silicate A (abbreviated as Crystalline Silicate in the tables) in the present invention. The resulting powder had a high ion exchange capacity of 305 $CaCO_3$ mg/g.

Preparation Example 2

(Amorphous Aluminosilicate)

Sodium carbonate was dissolved in ion-exchanged water, so as to prepare an aqueous solution with 6% by weight concentration. 132 g of the above aqueous solution and 38.28 g of a sodium aluminate aqueous solution (conc. 50% by weight) were placed in a 1000-ml reaction vessel equipped with baffles. 201.4 g of a solution prepared by diluting No. 3 liquid glass with water twice were added dropwise to the above mixed solution by under vigorous agitation at a temperature of 40° C. over a period of 20 minutes. Here, the reaction speed was optimized by blowing a $CO_2$ gas thereinto to thereby adjust the pH of the reaction system to 10.5. Thereafter, the reaction system was heated up to a temperature of 50° C. and stirred at the same temperature for 30 minutes. Subsequently, an excess alkali was neutralized by blowing a $CO_2$ gas thereinto to thereby adjust the pH of the reaction system to a pH of 9.0. The obtained neutralized slurry was filtered under a reduced pressure using a filter paper (No. 5C, manufactured by Toyo Roshi Kaisha, Ltd.). The filtered cake was rinsed with water in an amount of 1000 times that of the cake and dried under the conditions of 105° C., 300 Torr, and 10 hours. Further, the dried cake was disintegrated, to give an amorphous aluminosilicate powder in the present invention having an average particle size of 10 μm. Incidentally, the sodium aluminate aqueous solution was prepared by the steps of adding and mixing 243 g of $Al(OH)_3$ and 298.7 g of a 48% by weight NaOH aqueous solution in a 1000 ml four-necked flask, heating the mixture to a temperature of 110° C. with stirring, and maintaining the temperature of 110° C. for 30 minutes, to dissolve the components.

From the results of atomic absorption spectrophotometry and plasma emission spectrochemical analysis, the resulting amorphous aluminosilicate had the following composition: $Al_2O_3$=29.6% by weight; $SiO_2$=52.4% by weight; and $Na_2O$=18.0% by weight (1.0 $Na_2O.Al_2O_3.3.10\ SiO_2$). In addition, the calcium ion capturing capacity was 185 $CaCO_3$ mg/g, and the oil-absorbing capacity was 285 ml/100 g. The content of the microporous capacity having a microporous diameter of less than 0.1 μm was 9.4% by volume in the entire micropores, and the content of the microporous capacity having a microporous diameter of not less than 0.1 μm and not more than 2.0 μm was 76.3% by volume in the entire micropores. The water content was 11.2% by weight.

EXAMPLE 1

(Preparation of Granule Containing Crystalline Alkali Metal Silicate)

A liquid mixture was prepared by adding 22.50 parts by weight of a polyoxyethylene alkyl ether (nCl2 POE=8) and 3.75 parts by weight of an aliphatic monocarboxylic acid (C16), and heating and blending the above components so as to give a temperature of 70° C. Subsequently, 31.25 parts by weight of Crystalline Alkali Metal Silicate A prepared above, 4.00 parts by weight of 4A-type ZEOLITE, 13.00 parts by weight of Amorphous Aluminosilicate prepared above, and 1.25 parts by weight of sodium sulfite were supplied into Lödige mixer (manufactured by Matsuzaka Giken Co., Ltd.; capacity: 20 liters; equipped with a jacket), and agitation was initiated with the mixer having a main axis (150 rpm) and a chopper (4,000 rpm). Incidentally, heated water of 75° C. was supplied in the jacket at a flow rate of 10 liters/minute. To the above mixer, the liquid mixture was added in a period of 4 minutes, and after the added mixture was agitated for 10 minutes. Further, 8.50 parts by weight of 4A-type ZEOLITE were supplied as a surface coating agent, and the mixture was agitated for one minute, and then the resulting granule containing the crystalline alkali metal silicate were discharged. The granule (simply referred to as "Silicate Granules" in the tables) had an average particle size of 425 μm and a bulk density of 810 g/L. The entire amount supplied was 4 kg. Here, the average particle size is measured by a method according to JIS-K-3362.

(Preparation of Acidic Granule)

In a Lödige mixer similar to that used above, 4.50 parts by weight of an acrylic acid-maleic acid copolymer (degree of neutralization: 30 mol %) and 8.75 parts by weight sodium sulfate were supplied, and agitation was initiated with the mixer having a main axis (230 rpm) and a chopper (4,000 rpm). Incidentally, water at 20° C. was supplied in the jacket at a flow rate of 5 liters/minute. To the above mixer, 1.00 part by weight of water was added in a period of 3 minutes, and after the added mixture was agitated for 3 minutes. Further, 2.00 parts by weight of a pulverized product (average particle size: 6 μm) of sodium sulfate were supplied as a surface coating agent, and the mixture was agitated for one minute, and then the resulting acidic granule were discharged. The acidic granule had an average particle size of 350 μm. Here, the average particle size is measured by a method according to JIS-K-3362. The entire amount supplied was 3 kg.

Next, 500 g of the resulting acidic granule was placed in a fluidized bed-type dryer ("STREA-1," manufactured by Powrex Corp.), and the acidic granule was subjected to a drying treatment under the conditions of air capacity of 1.5 $m^3$/minute and a blasting temperature of 60° C. until 0.50 parts by weight of water in the acidic granule was evaporated. The resulting acidic granule had an average particle size of 330 μm and a bulk density of 885 g/L. Incidentally, the drying time was about 10 minutes.

Comparative Example 1

The starting materials listed in Table 1 were subjected to a granulation treatment by a method similar to the granulation treatment of the granule containing the crystalline alkali metal silicate as in Example 1, to give a granule containing the crystalline alkali metal silicate, the acidic ingredient, and other ingredients in one granule. The resulting granule had an average particle size of 410 μm and a bulk density of 860 g/L.

EXAMPLES 2 to 4

The granule containing the crystalline alkali metal silicate and the acidic granule were prepared by a granulation treatment described in Example 1. The compositions and the powder properties are shown in Tables 1 and 2.

Comparative Examples 2 and 3

Procedures similar to those of Comparative Example 1 were carried out, to give a granule containing the crystalline alkali metal silicate, the acidic ingredient, and other ingredients in one granule. The compositions and the powder properties are shown in Table 1.

Comparative Example 4

Procedures similar to those of Example 1 were carried out, to give a granule containing the crystalline alkali metal silicate and a separate granule containing a polymer. The compositions and the powder properties are shown in Table 2.

Test Example 1

The granules prepared above as detergent compositions were used to carry out a detergency test under the following conditions:

Preparation of Artificially Stained Cloth

An artificial staining liquid having the following compositions was adhered to a cloth (#2003 calico, manufactured by Tanigashira Shoten) to prepare an artificially stained cloth. Artificial staining liquid was printed on a cloth by an engravure staining machine equipped with an engravure roll coater. The process for adhering the artificial staining liquid to a cloth to prepare an artificially stained cloth was carried out under the conditions of a cell capacity of a gravure roll of 58 $cm^3/cm^2$, a coating speed of 1.0 m/min, a drying temperature of 100° C., and a drying time of one minute.

Composition of Artificial Staining Liquid

| | |
|---|---|
| Lauric acid | 0.44% by weight |
| Myristic acid | 3.09% by weight |
| Pentadecanoic acid | 2.31% by weight |
| Palmitic acid | 6.18% by weight |
| Heptadecanoic acid | 0.44% by weight |
| Stearic acid | 1.57% by weight |
| Oleic acid | 7.75% by weight |
| Triolein | 13.06% by weight |
| n-Hexadecyl palmitate | 2.18% by weight |
| Squalene | 6.53% by weight |
| Egg white lecithin crystalline liquid | 1.94% by weight |
| Kanuma sekigyoku soil | 8.11% by weight |
| Carbon black | 0.01% by weight |
| Tap water | Balance |

Washing Conditions

Washing of the above-mentioned artificially stained cloth in 4° DH water (Ca/Mg=3/1) was carried out by using turgotometer at a rotational speed of 100 rpm, at a temperature of 20° C. for 10 minutes, in which washing was carried out using the detergent compositions shown in Table 1 at a standard detergent concentration of 0.67 g/L. Incidentally, test results for the detergent concentration at 0.50 g/L are also given for the detergent compositions obtained in Example 2 and Comparative Example 2. Incidentally, the typical water hardness components in the water for washing are $Ca^{2+}$ and $Mg^{2+}$, whose weight ratios are generally in the range of Ca/Mg=(60–85)/(40–15). Here, a model sample of water of Ca/Mg=3/1 was used. The unit "° DH" refers to a water hardness which was calculated by replacing Mg ions with equimolar amounts of Ca ions.

Calculation of Detergency Rate

Reflectivities of the original cloth and those of the stained cloth before and after washing were measured at 550 nm by means of an automatic recording colorimeter (manufactured by Shimadzu Corporation), and the detergency rate D (%) was calculated by the following equation. The results thereof are also shown in Table 1.

$$D = \frac{(L_2 - L_1)}{(L_0 - L_1)} \times 100(\%),$$

wherein $L_0$: Reflectivity of the original cloth;

$L_1$: Reflectivity of the stained cloth before washing; and $L_2$: Reflectivity of the stained cloth after washing.

Incidentally, the materials shown in Tables 1 and 2 are as follows:

AS—Na (C12):

Powdered product of sodium lauryl sulfate, manufactured by Kao Corporation.

Fatty Acid (C16):

Palmitic acid, manufactured by Kao Corporation. Polyoxyethylene alkyl ether (C12-14):

Ethylene oxide adducts whose alkyl moieties are ascribed to a 1:1 (weight ratio) mixture of lauryl alcohol and myristyl alcohol, and whose ethylene oxide moieties have an average molar number of 8.0.

Crystalline Silicate B (Crystalline Alkali Metal Silicate B):

δ-$Na_2O.SiO_2$; "SKS-6™" (made available by Hoechst-Tokuyama K.K.); subjected to pulverization using a hammer-mill to an average particle size of 25 μm.

Sodium Silicate:

No. 1 powder sodium silicate, made available by The Nippon Chemical Industrial Co., Ltd.

AA-MA Copolymer (Degrees of Neutralization: 30% and 85%):

An acrylic acid-maleic acid copolymer with a molar ratio of acrylic acid:maleic acid=7:3; weight-average molecular weight: about 70000; a neutralized product (aqueous solution) was prepared and powdered by freeze-drying; manufactured by Kao Corporation.

Polyacrylic Acid (Degree of Neutralization: 30%):

Weight-average molecular weight: about 10000; powdered by freeze-drying it; manufactured by Kao Corporation.

Citric Acid:

Citric anhydride made available by Katayama Kagaku Kogyo K.K. was used; average particle size: 310 μm.

ZEOLITE:

4A-Type zeolite, made available by Tosoh Corporation; average particle size: 3 μm; the same zeolite pulverized to an average particle size of 1 μm using a hammer-mill was used as a surface coating agent.

Sodium Sulfate:

Anhydrous product thereof made available by Shikoku Kasei K.K.; average particle size: 100 μm; the same sodium sulfate finely pulverized to a size of 2 μm using a hammer-mill was used as a surface coating agent.

Sodium Sulfite:

Made available by Mitsui Toatsu Chemicals, Inc.

LAS(C12):

Sodium salt of linear alkylbenzenesulfonic acid whose alkyl moiety has 12 carbon atoms.

AS(C14–15):

Sodium salt of alkyl ether sulfuric acid whose alkyl moiety has 14 to 15 carbon atoms.

Fatty Acid (C12–20):

Fatty acid derived from palm oil.

TABLE 1

| | Example 1 | | |
|---|---|---|---|
| | Crystalline Silicate Granule | Acidic Granule | Compara. Example 1 |
| A)AS-Na (C12) | | | |
| Fatty Acid (C16) | 3.75 | | 3.75 |
| Polyoxyethylene Alkyl Ether (C12–14) | 22.50 | | 22.50 |
| B)Crystalline Silicate A | 31.25 | | 31.25 |
| Crystalline Silicate B | | | |
| C)ZEOLITE(Added upon Granulation) | 4.00 | | 4.00 |
| ZEOLITE(Surface Coating Agent) | 8.50 | | 8.50 |
| Amorphous Aluminosilicate | 13.00 | | 13.00 |
| D)AA-MA Copolymer (Degree of Neutralization: 30%) | | | |
| Polyacrylic Acid (Degree of Neutralization: 30%) | | 4.50 | 4.50 |
| Citric Acid | | | |
| Sodium Silicate | | | |
| Sodium Sulfate | | 8.75 | 8.75 |
| Sodium Sulfate (Surface Coating Agent) | | 2.00 | 2.00 |
| Sodium Sulfite | 1.25 | | 1.25 |
| Water | | 0.50 | 0.50 |
| Total of Each Granules (wt %) | 84.25 | 15.75 | |
| Total of Entire Composition (wt %) | 100.00 | | 100.00 |
| Property of Granules | | | |
| Average Particle Size (μm) | 425 | 350 | 410 |
| Bulk Density (g/L) | 810 | 885 | 860 |
| pH at Standard Detergent Concentration (0.67 g/L) | 10.95 | | 10.90 |
| Detergency (%) | 69.0 | | 62.5 |

| | Example 2 | | |
|---|---|---|---|
| | Crystalline Silicate Granule | Acidic Granule | Compara. Example 2 |
| A)AS-Na (C12) | | | |
| Fatty Acid (C16) | 5.00 | | 5.00 |
| Polyoxyethylene Alkyl Ether (C12–14) | 20.00 | | 20.00 |
| B)Crystalline Silicate A | 35.00 | | 35.00 |
| Crystalline Silicate B | | | |
| C)ZEOLITE(Added upon Granulation) | 4.20 | | 4.20 |
| ZEOLITE(Surface Coating Agent) | 8.50 | | 8.50 |
| Amorphous Aluminosilicate | 11.67 | | 11.67 |
| D)AA-MA Copolymer (Degree of Neutralization: 30%) | | 5.00 | 5.00 |
| Polyacrylic Acid (Degree of Neutralization: 30%) | | | |
| Citric Acid | | | |
| Sodium Silicate | | | |
| Sodium Sulfate | | 6.46 | 6.46 |
| Sodium Sulfate (Surface Coating Agent) | | 2.00 | 2.00 |
| Sodium Sulfite | 1.67 | | 1.67 |
| Water | | 0.50 | 0.50 |
| Total of Each Granules (wt %) | 86.04 | 13.96 | |
| Total of Entire Composition (wt %) | 100.00 | | 100.00 |
| Property of Granules | | | |
| Average Particle Size (μm) | 440 | 365 | 405 |
| Bulk Density (g/L) | 805 | 860 | 850 |
| pH at Standard Detergent Concentration (0.67 g/L) | 11.02 | | 10.96 |
| Detergency (%) | 71.3 | | 65.1 |
| pH at Standard Detergent Concentration (0.50 g/L) | 10.90 | | 10.84 |
| Detergency (%) | 61.7 | | 55.2 |

| | Example 3 | | |
|---|---|---|---|
| | Crystalline Silicate Granule | Acidic Granule | Compara. Example 3 |
| A)AS-Na (C12) | 6.25 | | 6.25 |
| Fatty Acid (C16) | 3.75 | | 3.75 |
| Polyoxyethylene Alkyl Ether (C12–14) | 15.00 | | 15.00 |
| B)Crystalline Silicate A | | | |
| Crystalline Silicate B | 25.00 | | 25.00 |
| C)ZEOLITE(Added upon Granulation) | 4.00 | | 4.00 |
| ZEOLITE(Surface Coating Agent) | 8.50 | | 8.50 |
| Amorphous Aluminosilicate | 8.75 | | 8.75 |
| D)AA-MA Copolymer (Degree of Neutralization: 30%) | | 6.25 | 6.25 |
| Polyacrylic Acid (Degree of Neutralization: 30%) | | | |
| Citric Acid | | 2.50 | 2.50 |
| Sodium Silicate | 3.75 | | 3.75 |
| Sodium Sulfate | 2.00 | 8.50 | 10.50 |
| Sodium Sulfate (Surface Coating Agent) | | 3.50 | 3.50 |
| Sodium Sulfite | 1.25 | | 1.25 |
| Water | | 1.00 | 1.00 |
| Total of Each Granules (wt %) | 78.25 | 21.75 | |
| Total of Entire Composition (wt %) | 100.00 | | 100.00 |
| Property of Granules | | | |
| Average Particle Size (μm) | 395 | 430 | 370 |
| Bulk Density (g/L) | 790 | 850 | 835 |
| pH at Standard Detergent Concentration (0.67 g/L) | 10.86 | | 10.81 |
| Detergency (%) | 611.5 | | 58.4 |

TABLE 2

| | Example 4 | | Compara. Example 4 | |
|---|---|---|---|---|
| | Crystalline Silicate Granule | Acidic Granule | Crystalline Silicate Granule | Polymer Granule |
| A)Fatty Acid (C12–20) | 5.00 | | 5.00 | |
| Polyoxyethylene Alkyl Ether (C12–14) | 20.00 | | 20.00 | |
| B)Crystalline Silicate A | 40.00 | | 33.33 | |
| Crystalline Silicate B | | | | |
| C)ZEOLITE | 8.33 | | 14.23 | |
| Amorphous Aluminosilicate | 11.67 | | 11.67 | |
| D)AA-MA Copolymer (Degree of Neutralization: 30%) | | 5.00 | | |
| AA-MA Copolymer (Degree of Neutralization: 85%) | | | | 5.77 |
| Sodium Sulfate | | 5.00 | | 5.00 |
| Sodium Sulfite | 1.67 | | 1.67 | |
| Other Ingredients | | 3.33 | | 3.33 |
| Total of Each Granule (wt %) | 86.67 | 13.33 | 85.90 | 14.10 |
| Total of Entire Composition (wt %) | 100.00 | | 100.00 | |
| Detergent Concentration (g/L) | 0.50 | | 0.50 | |
| pH | 10.95 | | 10.95 | |
| Detergency (%) | 60.2 | | 57.4 | |

As indicated by the above results, the granular detergent compositions for clothes washing of the present invention have high maximum pHs, thereby resulting in high detergency.

On the other hand, in cases of Comparative Examples 1 to 3 where the crystalline alkali metal silicate and the acidic ingredient are present in the same granule, the maximum pHs are low, thereby resulting in low detergency.

Also, even in a case of Example 4 and Comparative Example 4 where the compositions are varied so as to have the same maximum pH compared, the granular detergent composition of the present invention has higher detergency than that of comparative detergent composition.

In addition, the detergency performance for cases where the water hardness is harder than the water used is evaluated using the detergent composition used in Example 3. Washing tests are carried out under the conditions of a washing temperature of 30° C. and a detergent concentration of 1.46 g/L in a case where the water used is 8° DH, and under the conditions of a washing temperature of 400° C. and a detergent concentration of 5.33 g/L in a case where the water used is 15° DH. As a result, advantageous detergency can be obtained when compared to a case where the composition is the same and an acid ingredient is formulated in the same granule. Incidentally, other washing conditions are the same as those of Example 1 to 4.

INDUSTRIAL APPLICABILITY

In the granular detergent composition containing the crystalline alkali metal silicate, the granular detergent composition for clothes washing of the present invention gives sufficient washing performance, thereby showing even superior detergency.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A granular detergent composition for clothes washing comprising a surfactant, a metal ion capturing agent having a calcium ion capturing ability of 100 $CaCO_3$ mg/g or higher, a crystalline alkali metal silicate, and an acidic ingredient, wherein said metal ion capturing agent is a component other than the crystalline alkali metal silicate and other than the acidic ingredient, and wherein said granular detergent composition comprises at least two different granules:

a first granule comprising the crystalline alkali metal silicate but excluding an acidic ingredient, and a second granule, which is an acidic granule, comprising the acidic ingredient, the crystalline alkali metal silicate and the acidic ingredient being present in different granules to prevent neutralization reaction from taking place, and wherein said granular detergent composition is alkaline in distilled water at 25° C. and has a bulk density of 650 g/L or more.

2. The granular detergent composition for clothes washing according to claim 1, wherein the granular detergent composition is usable for water for washing with a water hardness of from 2 to 6° DH, wherein a maximum pH 25 at 25° C. is from 10.70 to 11.50 at a detergent concentration in distilled water of 0.67 g/L.

3. The granular detergent composition for clothes washing according to claim 1, wherein the granular detergent composition is usable for water for washing with a water hardness of from 6 to 10° DH, wherein a maximum pH at 25° C. is from 10.70 to 11.50 at a detergent concentration in distilled water of 1.46 g/L.

4. The granular detergent composition for clothes washing according to claim 1, wherein the granular detergent composition is usable for water for washing with a water hardness of from 10 to 20° DH, wherein a maximum pH at 25°C. is from 10.70 to 11.50 at a detergent concentration in distilled water of 5.33 g/L.

5. The granular detergent composition for clothes washing according to claim 1, wherein the granule containing the crystalline alkali metal silicate is produced by granulating and/or coating the crystalline alkali metal silicate together with a mixture comprising at least one surfactant and at least one aluminosilicate.

6. The granular detergent composition for clothes washing according to claim 5, wherein the granule containing the crystalline alkali metal silicate is obtained by granulating the crystalline alkali metal silicate together with a surfactant mixture, the surfactant mixture being gelated or solidified on a surface of the crystalline alkali metal silicate.

7. The granular detergent composition for clothes washing according to claim 6, wherein the surfactant mixture which is gelated or solidified on the surface of the crystalline alkali metal silicate is formed by at least one fatty acid or a salt thereof.

8. The granular detergent composition for clothes washing according to claim 1, wherein the acidic granule containing the acidic ingredient is obtained by granulating the acidic ingredient together with a mixture comprising inorganic sulfates or chlorides showing neutral or acidic properties.

9. The granular detergent composition for clothes washing according to claim 1, wherein the acidic granule containing the acidic ingredient does not contain carbonates, hydrogencarbonates, and sulfites.

10. The granular detergent composition for clothes washing according to claim 1, wherein the acidic granule containing the acidic ingredient contains substantially none of aluminosilicates.

11. The granular detergent composition for clothes washing according to claim 1, wherein any of the granules in the detergent composition do not contain carbonates and hydrogencarbonates.

12. The granular detergent composition for clothes washing according to claim 1, wherein the granule containing the crystalline alkali metal silicate contains a surfactant, a crystalline alkali metal silicate, and an aluminosilicate, and wherein the acidic granule containing the acidic ingredient contains an acidic ingredient and inorganic salts other than carbonates, hydrogencarbonates, and sulfites.

13. The granular detergent composition for clothes washing according to claim 1, wherein said surfactant is selected from the group consisting of nonionic surfactants, anionic surfactants, cationic surfactants, and amphoteric surfactants.

* * * * *